US005631623A

United States Patent [19]

Yoshimura

[11] Patent Number: 5,631,623

[45] Date of Patent: May 20, 1997

[54] CHIP-TYPE VARIABLE RESISTOR

[75] Inventor: Tamotsu Yoshimura, Kyoto, Japan

[73] Assignee: Rohm Co., Ltd., Kyoto, Japan

[21] Appl. No.: 618,089

[22] Filed: Mar. 19, 1996

Related U.S. Application Data

[63] Continuation of Ser. No. 233,774, Apr. 26, 1994.

[30] Foreign Application Priority Data

Apr. 26, 1993 [JP] Japan ..... 5-099747
Sep. 13, 1993 [JP] Japan ..... 5-227453

[51] Int. Cl.[6] ..... H01C 10/32

[52] U.S. Cl. ..... 338/142; 338/190; 338/89; 338/122; 338/217; 338/162

[58] Field of Search ..... 338/118–122, 89–91, 338/138–142, 195, 217, 335, 160, 162, 190

[56] References Cited

U.S. PATENT DOCUMENTS

| | | | |
|---|---|---|---|
| 432,131 | 7/1890 | Flemming | 338/142 |
| 686,246 | 11/1901 | Bachmann et al. | 338/217 |
| 1,971,053 | 8/1934 | Ruben | 338/138 |
| 2,089,425 | 8/1937 | Ragatz et al. | 338/138 |
| 2,134,870 | 11/1938 | Fruth | 338/217 |
| 3,684,998 | 8/1972 | Zablocki | 338/174 |
| 4,032,881 | 6/1977 | Singleton | 338/195 |
| 4,283,704 | 8/1981 | Ohtani et al. | 338/138 |
| 4,994,782 | 2/1991 | Watanabe et al. | 338/160 |
| 5,051,719 | 9/1991 | Gaston et al. | 338/162 |
| 5,095,298 | 3/1992 | Chapman et al. | 338/162 |

FOREIGN PATENT DOCUMENTS

| | | | |
|---|---|---|---|
| 2-17805 | 2/1990 | Japan . | |
| 2-137201 | 5/1990 | Japan . | |
| 2-125303 | 10/1990 | Japan . | |
| 428820 | 5/1935 | United Kingdom | 338/217 |
| 437086 | 10/1937 | United Kingdom | 338/122 |
| 479046 | 1/1938 | United Kingdom | 338/138 |
| 1246437 | 9/1971 | United Kingdom | 338/89 |

*Primary Examiner*—Teresa J. Walberg
*Assistant Examiner*—Karl Easthom
*Attorney, Agent, or Firm*—William H. Eilberg

[57] ABSTRACT

A chip-type variable resistor is provided which includes an insulating substrate formed with a resistor strip which is arcuate at least partially and has both ends electrically connected to respective extremity electrode terminals, an intermediate terminal member mounted to the substrate, and a contact member electrically connected to the intermediate terminal member and rotatably mounted to the substrate in slidable contact with the resistor strip. The resistor strip includes at least one portion having a lower area resistivity (defined as a resistance per unit surface area) and at least another portion having a higher area resistivity.

6 Claims, 9 Drawing Sheets

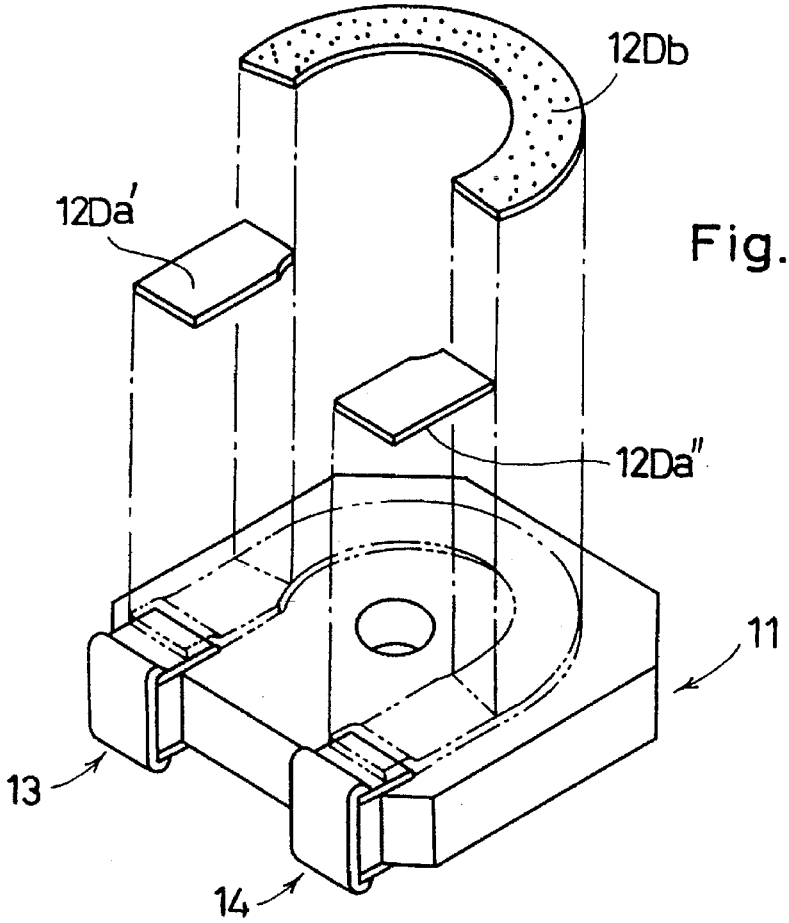
Fig. 14
Fig. 15
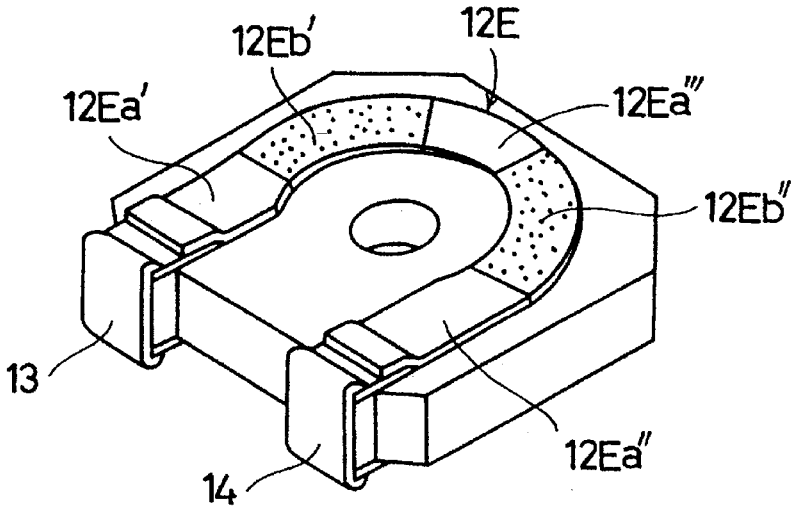

CHIP-TYPE VARIABLE RESISTOR

This application is a continuation of application Ser. No. 08/233,774, filed Apr. 26, 1994.

BACKGROUND OF THE INVENTION

1. Field of the Invention

This invention relates generally to a variable resistor. More particularly, the present invention relates to a chip-type variable resistor wherein the resistance can be adjusted by rotating a rotor relative to an insulating substrate which carries a printed resistor strip.

2. Description of the Prior Art

A variable resistor of the above-described type is disclosed for example in Japanese Utility Model Application Laid-open No. 2(1990)-17805. For conveniently describing the prior art, reference is now made to FIGS. 16 and 17 of the accompanying drawings.

As shown in FIGS. 16 and 17, the prior art chip-type variable resistor comprises an insulating substrate 1 made of a ceramic material for example. The substrate 1 has a central bore 1*a*, and carries a generally U-shaped resistor strip 2 including an arcuate portion which is centered about the central bore 1*a*. The respective ends of the resistor strip 2 are electrically connected to extremity electrode terminals 3, 4 arranged at one side of the substrate 1 as spaced from each other along said one side.

The underside of the substrate 1 carries an intermediate terminal member 6 which is made of a metal and integrally formed with a cylindrical support shaft portion 6*a* fitted in the central bore 1*a* of the substrate 1. A metallic rotor 5 is rotatably fitted on the shaft portion 6*a* of the terminal member 6 and has a downwardly directed contact portion 5*a* for coming into slidable contact with the resistor strip 2. Thus, the resistance of the variable resistor can be adjusted by turning the rotor 5 with a rotational range θ' (FIG. 2).

According to the prior art arrangement described above, the resistor strip 1 is uniformly formed to have a constant width and a constant thickness substantially over the entire length thereof. Thus, as shown in FIG. 18, if the nominal overall resistance R of the resistor is relatively large, the inclination (defined as $dr'/d\theta'$) of the resistance variation within the rotational range θ' of the rotor becomes inevitably steep. In such a case, it is possible to provide only a coarse adjustment of resistance.

SUMMARY OF THE INVENTION

It is, therefore, an object of the present invention to provide a chip-type variable resistor which, while providing a relatively large nominal resistance, is capable of finely adjusting the resistance in a desired range.

According to the present invention, there is provided a chip-type variable resistor comprising: an insulating substrate formed with a resistor strip which is arcuate at least partially and has both ends electrically connected to respective extremity electrode terminals; an intermediate terminal member mounted to the substrate; and a contact member electrically connected to the intermediate terminal member and rotatably mounted to the substrate in slidable contact with the resistor strip; wherein the resistor strip includes at least one portion having a lower area resistivity, the area resistivity being defined as a resistance per unit surface area, the resistor strip also including at least another portion having a higher area resistivity.

According to one embodiment of the present invention, the resistor strip comprises a first resistor layer extending for the full length of the resistor strip, and a second resistor layer formed in lamination with the first resistor layer, wherein the second resistor layer is shorter than the first resistor strip to be spaced from at least one of the extremity electrode terminals. The second resistor layer may include a plurality of layer portions which are spaced from each other.

According to another embodiment of the present invention, the resistor strip is single layered. In this case, the resistor strip comprises at least one first material portion made of a higher resistivity material and electrically connected to one of the extremity electrode terminals, and at least one second material portion made of a lower resistivity material and spaced from said one of the extremity electrode terminals via the first material portion.

Other objects, features and advantages of the present invention will be fully understood from the following detailed description of the preferred embodiments given with reference to the accompanying drawings.

BRIEF DESCRIPTION OF THE DRAWINGS

In the accompanying drawings:

FIG. 14 is a perspective view showing the resistor of FIG. 13 in an exploded condition; and FIG. 15 is a perspective view showing a still further chip-type variable resistor embodying the present invention;

DETAILED DESCRIPTION OF THE PREFERRED EMBODIMENTS

Figure 1:
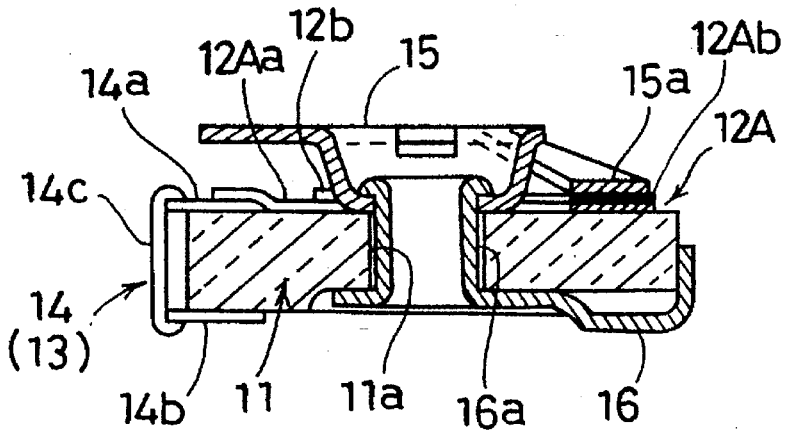
FIG. 1 is a side view, in vertical section, showing a chip-type variable resistor embodying the present invention.
Figure 2:
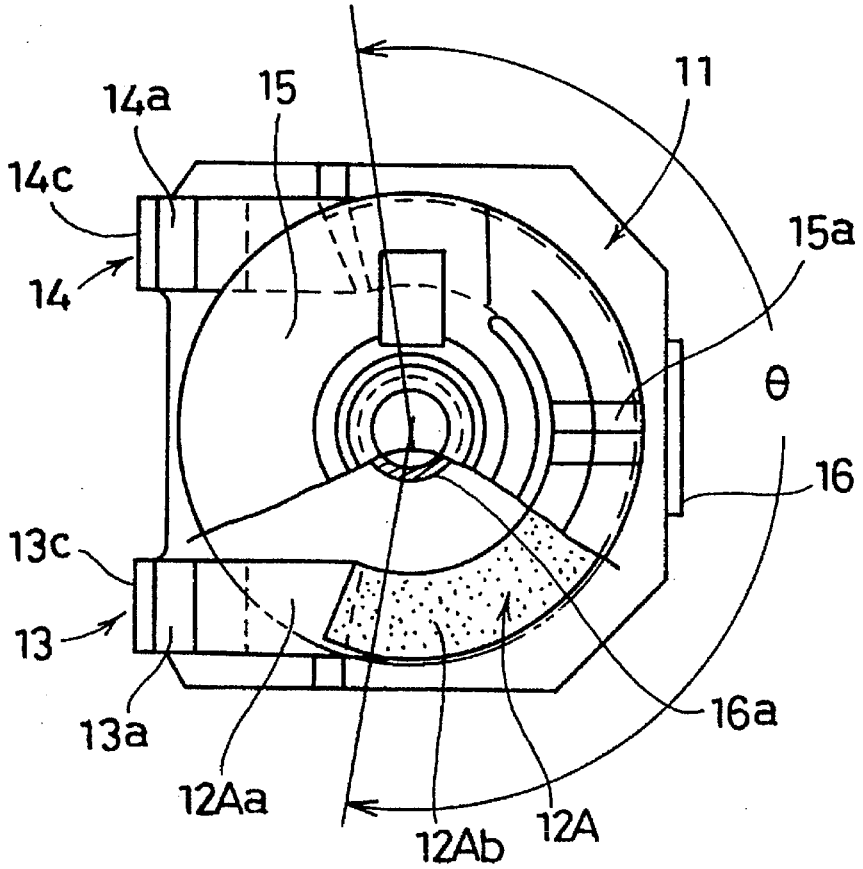
FIG. 2 is a plan view showing the same resistor.
Figure 3:
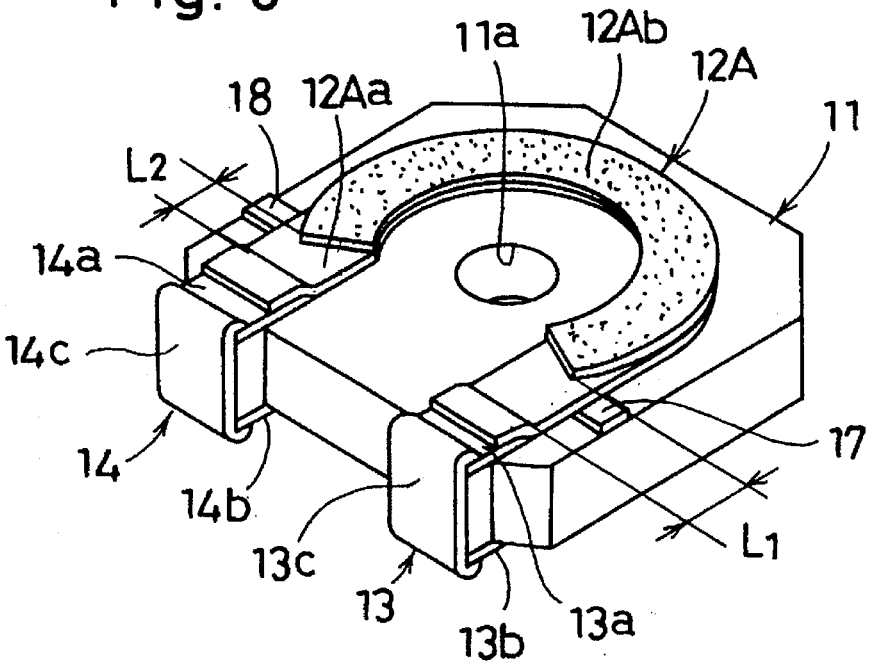
FIG. 3 is a perspective view showing the same resistor with a rotor removed.

FIGS. 1 through 3 of the accompanying drawings illustrate a chip-type variable resistor according to a first embodiment of the present invention.

The variable resistor of the first embodiment comprises an insulating substrate (chip) 11 made of a ceramic material for example. The substrate 11 has a central bore 11*a*, and carries a generally U-shaped resistor strip 12A including an arcuate portion which is centered about the central bore 11*a*. The resistor strip 12A may be formed by the successive steps of applying a paste of resistor material on the upper surface of the substrate (by the screen printing method for example) and baking the paste.

The respective ends of the resistor strip 12A are electrically connected to extremity electrode terminals 13, 14 arranged at one side of the substrate 11 as spaced from each other along said one side. Each of the extremity terminals 13, 14 includes an upper electrode portion 13*a*, 14*a*, a lower electrode portion 13*b*, 14*b* and a side electrode portion 13*c*, 14*c* connecting between the corresponding upper and lower electrode portions.

The underside of the substrate 11 carries an intermediate terminal member 16. The terminal member 16 is integrally formed with a cylindrical support shaft portion 16*a* fitted in the central bore 11*a* of the substrate 11. The terminal member 16 may be made by working a metal plate.

The variable resistor further comprises a rotor 15 which is made by working a metal plate. The rotor 15 is rotatably fitted on the shaft portion 16*a* of the terminal member 16 but axially fixed thereto by plastically enlarging (crimping) the upper end of the shaft portion 16*a*. Further, the rotor 15 has a downwardly directed contact portion 15*a* for coming into slidable contact with the resistor strip 12A.

According to the first embodiment, the resistor strip 12A has a partial double layer structure. Specifically, the resistor strip 12A includes a first resistor layer 12A*a* which extends along the entire length of the resistor strip 12A into direct electrical connection with the respective upper electrode portions 13*a*, 14*a* of the two extremity terminals 13, 14, and a second resistor layer 12A*b* formed on the first resistor layer 12A*a* substantially in an arcuate form but spaced from the respective upper electrode portions 13*a*, 14*a* by respective distances L1, L2 (FIG. 3). These distances may be equal to each other.

With the arrangement described above, the resistance of the variable resistor can be adjusted by turning the rotor 15 on the shaft portion 16*a* of the intermediate terminal member 16 within a rotational angular range θ (FIG. 2) to change the position of the contact portion 15*a* relative to the resistor strip 12A. The adjusted resistance is given across one of the extremity terminals 13, 14 and the intermediate terminal member 16, whereas the nominal overall resistance is given across the respective extremity terminals 13, 14.

As previously described, the resistor strip 12A has a partial double structure which is provided by the first resistor layer 12A*a* directly connected to the respective extremity terminals 13, 14 as well as by the second resistor layer 12A*b* formed on the first resistor layer 12A*a* but spaced from the respective extremity terminals 13, 14. Obviously, since the cross section of the resistor strip 12A increases where the second resistor layer 12A*b* is formed, the double layer portion of the resistor strip 12A has a lower area resistivity (defined as a resistance per unit surface area, unit surface area being defined as unit length of the resistor strip multiplied by unit width of the strip) than the single layer portions of the same resistor strip in the end regions (distances) L1, L2.

Figure 4:
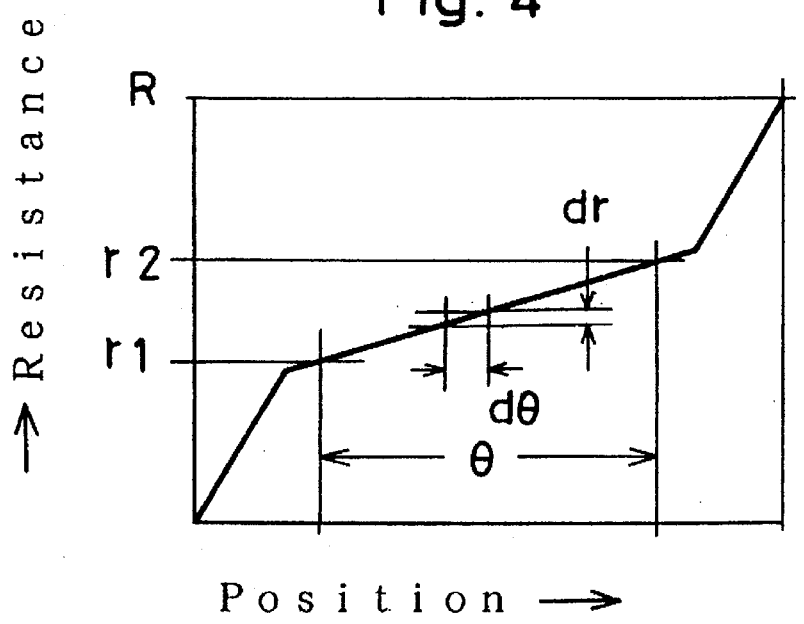
FIG. 4 is a graph showing the resistance characteristics of the same resistor.

FIG. 4 is a graph showing the resistance characteristics of the variable resistor according to the first embodiment described above. In FIG. 4, the abscissa represents the position along the resistor strip 12A relative to one extremity terminal 13, whereas the ordinate represents the resistance of the variable resistor.

As can been appreciated from the graph of FIG. 4, the resistance of the variable resistor varies along the resistor strip 12A, but the gradient (namely, dr/dθ) of the resistance variation is lower in the rotational range θ (adjustable resistance range) of the rotor 15 (FIG. 1) than in the end regions L1, L2 (non-adjustable regions) of the resistor strip 12A. Thus, it is possible to make fine resistance adjustment between an adjustable minimum value r1 and an adjustable maximum value r2 while also providing a relatively high nominal overall resistance R.

Returning to FIG. 3, the insulating substrate 11 may be preferably formed with a pair of auxiliary conductor pads 17, 18 in electrical connection with the resistor strip 12A at respective ends of the double layer portion (the second resistor layer 12A*b*). The auxiliary conductor pads 17, 18 together with the extremity terminals 13, 14 are selectively brought into contact with resistance measuring probes (not shown) for facilitating resistance measurement with respect to the double layer portion and end regions of the resistor strip 12A. The provision of the auxiliary conductor pads 17, 18 is particularly significant because the resistor strip 12A of the partial double layer structure tends to fluctuate due to various factors (e.g. positional deviations between the first and second resistor layers 12A*a*, 12A*b*), so that it is necessary to check whether the double layer portion and end regions of the resistor strip 12A have their intended resistance values in the process of making the variable resistor.

The variable resistor according to the first embodiment may be manufactured in the following manner.

Figure 5:
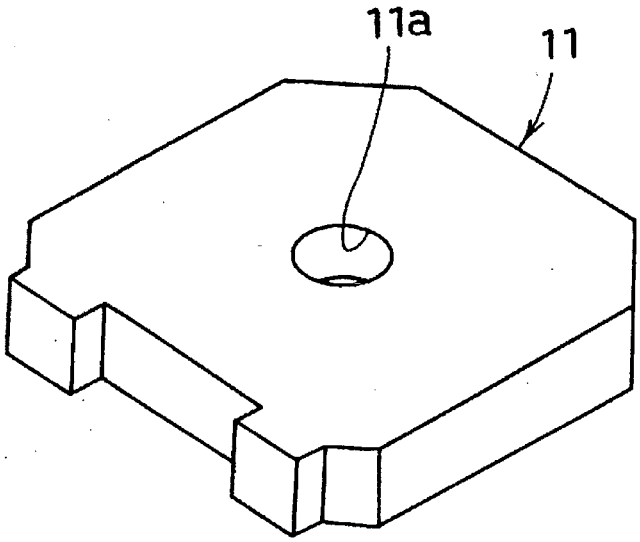
FIGS. 5 through 8 are perspective views showing the successive steps of manufacturing the same resistor.

First, an insulating substrate 11 is prepared as a unit substrate, as shown in FIG. 5. Such a unit substrate may be obtained by dividing a larger material plate in rows and columns.

Figure 6:
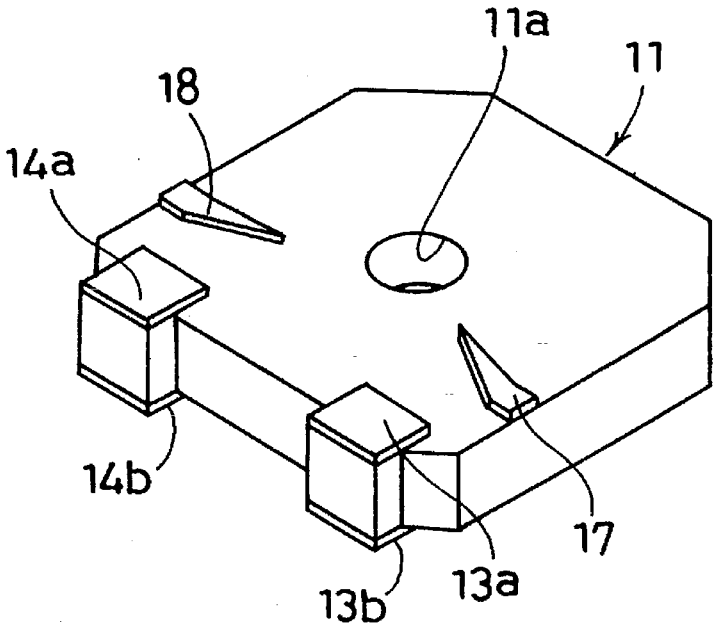

Then, as shown in FIG. 6, lower electrode portions 13*b*, 14*b* for the respective extremity electrode terminals 13, 14 are formed by applying a conductive paste (e.g. silver paste) to the underside of the substrate 11. The process step for the underside of the substrate 11 precedes because other process steps are performed successively with respect to the upper surface of the substrate 11.

Then, as also shown in FIG. 6, upper electrode portions 13*a*, 14*a* for the respective extremity electrode terminals 13, 14 are formed together with auxiliary conductor pads 17, 18 by applying a conductive paste (e.g. silver paste) to the upper surface of the substrate 11. Obviously, the upper electrode portions 13*a*, 14*a* and the auxiliary conductor pads 17, 18 may be made of different conductive pastes and formed successively.

Figure 7:
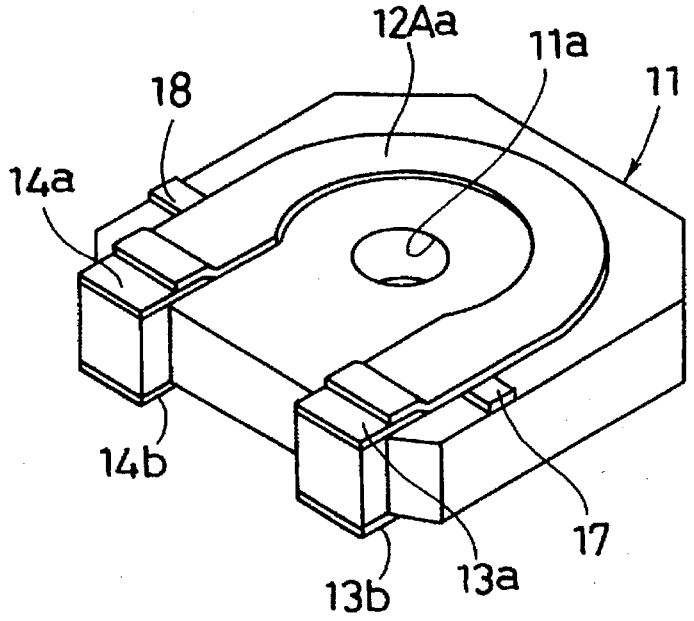

Then, as shown in FIG. 7, a first resistor layer 12A*a* is formed on the upper surface of the substrate 11 by applying a suitable resistor material paste. At this time, the first resistor layer 12A*a* is made to partially overlap the upper electrode portions 13*a*, 14*a* and the auxiliary conductor pads 17, 18 for electrical connection therewith.

Figure 8:
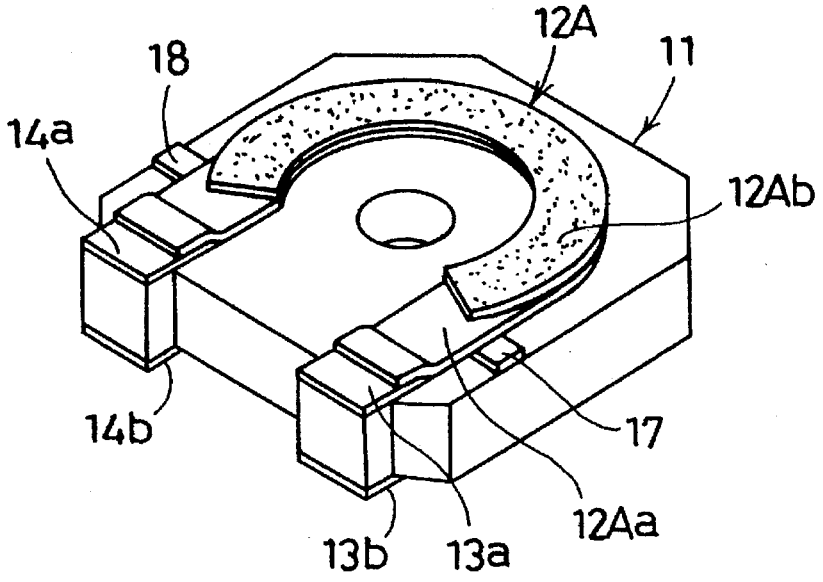

Then, as shown in FIG. 8, a second resistor layer 12A*b* is formed on the first resistor layer 12A*a* by applying a suitable resistor material paste. The resistor material for the second resistor layer 12A*b* may be identical to or different from that for the first resistor layer 12A*a*.

Then, side electrode portions 13*c*, 14*c* (see FIG. 3) for the respective extremity electrode terminals 13, 14 are formed by applying a conductive paste (e.g. silver paste) to a relevant side face of the substrate 11.

Finally, a rotor 15 (see FIG. 1) and an intermediate terminal member 16 are mounted to the substrate 11 in a known manner, thereby providing a variable resistor as a product.

The process steps up to the formation of the side electrode portions 13*c*, 14*c* (FIG. 3) may be performed while the unit insulating substrate 11 still forms a part of a bar-like substrate (corresponding to a plurality of unit substrates), as disclosed in Japanese Patent Application Laid-open No. 2(1990)-137201. In this case, the unit substrate 11 is later cut off from the bar-like substrate together with other unit substrates.

According to the manufacturing process described above, the first resistor layer 12A*a* is formed prior to the formation of the second resistor layer 12Ab. However, the second (shorter) resistor layer 12A*b* is formed first to partially overlap the respective auxiliary conductor pads 17, 18, and the first (longer) resistor layer 12A*a* is then formed to overlap the second resistor layer 12A*b* and the respective upper electrode portions 13*a*, 14*a*.

Further, the first and second resistor layers 12A*a*, 12A*b* may be baked together for fixation regardless of which is first applied or deposited. Such simultaneous baking of the first and second resistor layers 12A*a*, 12A*b* is preferable in that abrupt steps (abrupt level difference) between the first and second resistor layers can be eliminated.

Figure 9:
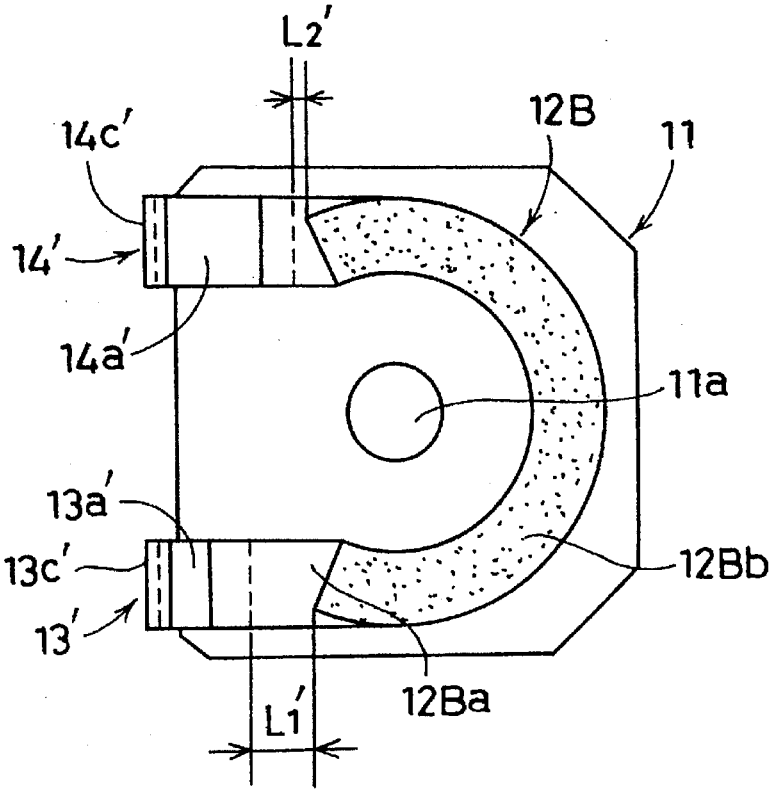
FIG. 9 is a plan view showing another chip-type variable resistor embodying the present invention.

FIG. 9 shows a chip-type variable resistor according to a second embodiment of the present invention. Similarly to the foregoing embodiment, the resistor of this embodiment comprises an insulating substrate (chip) 11, a generally U-shaped resistor strip 12B including an arcuate portion, and a pair of extremity electrode terminals 13', 14'. The resistor strip 12B includes a first (longer) resistor layer 12B*a* and a second (shorter) resistor layer 12B*b* which is substantially arcuate. Though not shown, the resistor also comprises a rotor having a contact portion, and an intermediate terminal member.

According to the second embodiment, the upper electrode portion 13*a'* for one extremity electrode terminal 13' is made shorter than the upper electrode portion 14*a'* for the other extremity electrode terminal 14'. Thus, the spacing L1' between the second resistor layer 12B*b* and the upper electrode portion 13*a'* is made larger than the spacing L2' between the second resistor layer 12B*b* and the other upper electrode 14*a'*. In other words, the resistor strip 12B has a longer single layer end portion near the extremity electrode terminal 13', and a shorter single layer end portion near the other extremity electrode terminal 14'.

Figure 10:
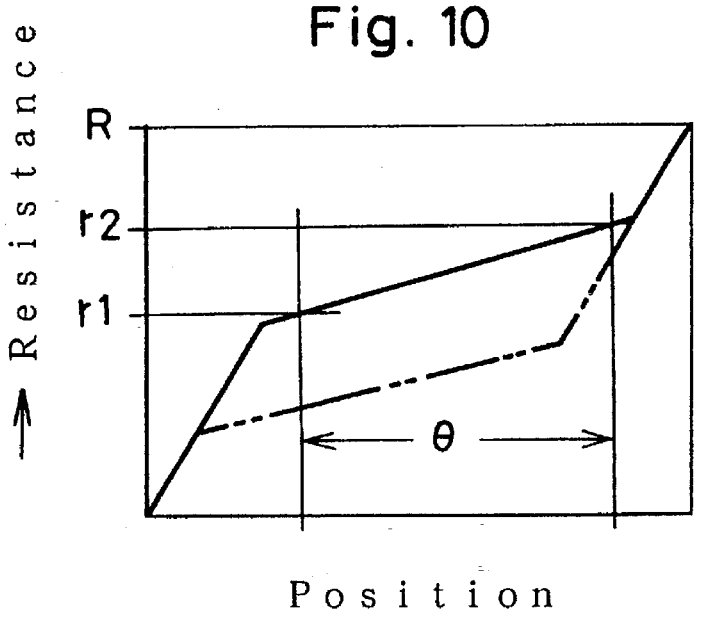
FIG. 10 is graph showing the resistance characteristics of the resistor shown in FIG. 9.

FIG. 10 is a graph showing the resistance characteristics of the variable resistor according to the second embodiment. As can been appreciated from this graph, the adjustable resistance range θ wherein the gradient of resistance variation is reduced is shifted upward in comparison with the resistance characteristics shown in FIG. 4. Thus, the minimum value r1' and maximum value r2' of the adjustable range θ can be set at higher levels.

Apparently, by elongating the upper electrode portion 13*a'* while shortening the other upper electrode portion 14*a'*, the spacing L1' between the second resistor layer 12B*b* and the upper electrode portion 13*a'* may be made smaller than the spacing L2' between the second resistor layer 12B*b* and the upper electrode 14*a'*. According to such an alternative arrangement, the adjustable resistance range θ can be lowered as a whole, as indicated by broken lines in FIG. 10. Further, the value of either spacing L1' or L2' may be zero to maximally shift the adjustable resistance range O upward or downward.

Figure 11:
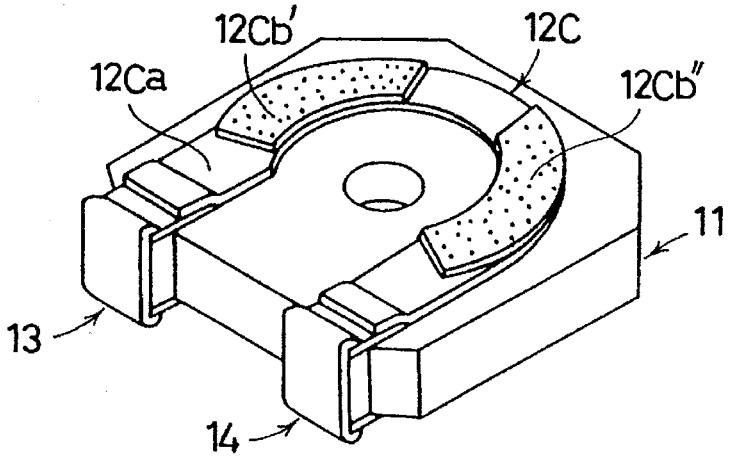
FIG. 11 is a plan view showing still another chip-type variable resistor embodying the present invention.

FIG. 11 shows a chip-type variable resistor according to a third embodiment of the present invention. The resistor of this embodiment is similar to that of the first embodiment but differs therefrom only in that a resistor strip 12C includes, in addition to a first resistor layers 12C*a*, a pair of second resistor layer portions 12C*b'*, 12C*b"* which are spaced not only from the respective extremity electrode terminals 13, 14 but also from each other. The respective second resistor layer portions 12C*b'*, 12C*b"* may be equal to or different from each other in length.

Figure 12:
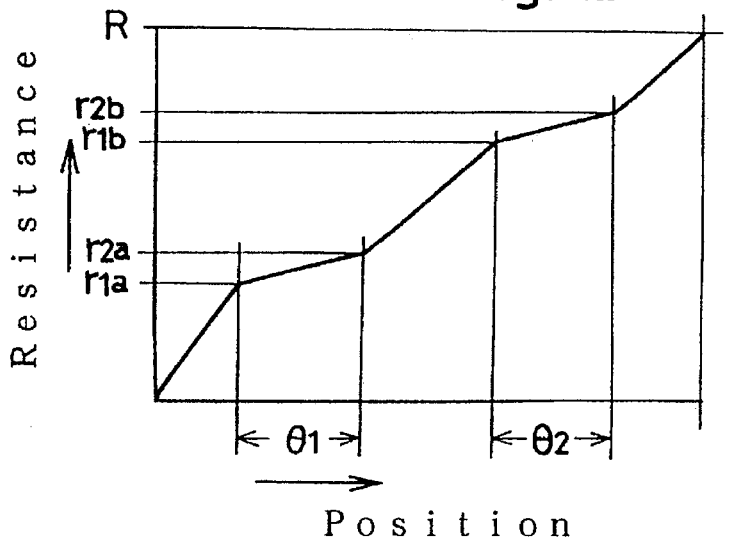
FIG. 12 is graph showing the resistance characteristics of the resistor shown in FIG. 11.

FIG. 12 is a graph showing the resistance characteristics of the variable resistor according to the third embodiment. As can been appreciated from this graph, the resistance characteristic curve is made to have a first finely adjustable range θ1 (lower-side finely adjustable range) between a first minimum value r1a and a maximum value r2a, and a second finely adjustable range θ2 (higher-side finely adjustable range) between a second minimum value r1b and a second maximum value r2b. Further, there is also provided a coarsely adjustable range between the first finely adjustable range θ1 and the second finely adjustable range θ2.

In either of the second and third embodiments, the second resistor layer 12B*b* or layer portions 12C*b'*, 12C*b"* may be formed under the first resistor layer 12B*a* or 12C*a*. Further, the second resistor layer or layers may be baked for fixation together with the first resistor layer, thereby preventing the formation of abrupt steps between the first resistor layer and the second resistor layer or layer portions.

Figure 13:
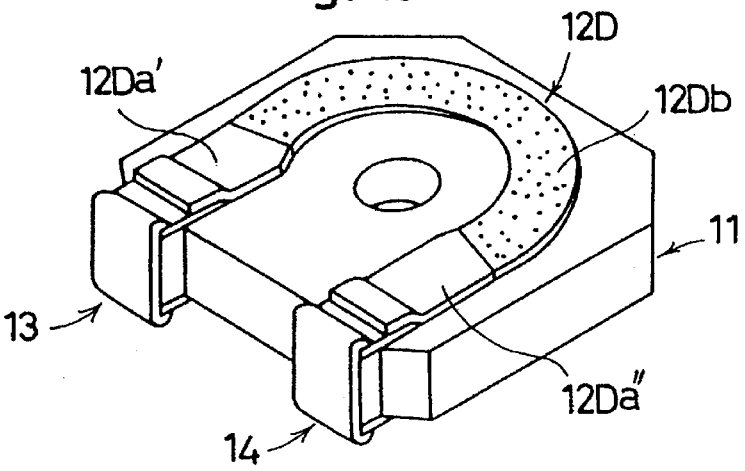
FIG. 13 is a perspective view showing a further chip-type variable resistor embodying the present invention.
Figure 16:
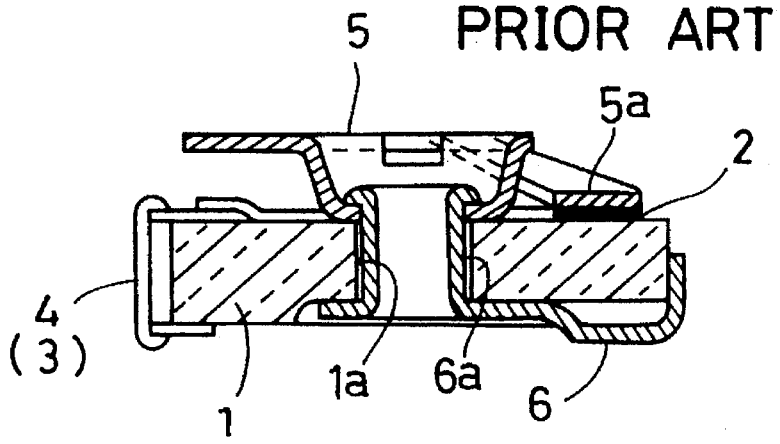
Fig. 16 PRIOR ART
FIG. 16 is a side view, in vertical section, showing a prior art chip-type variable resistor.
Figure 17:
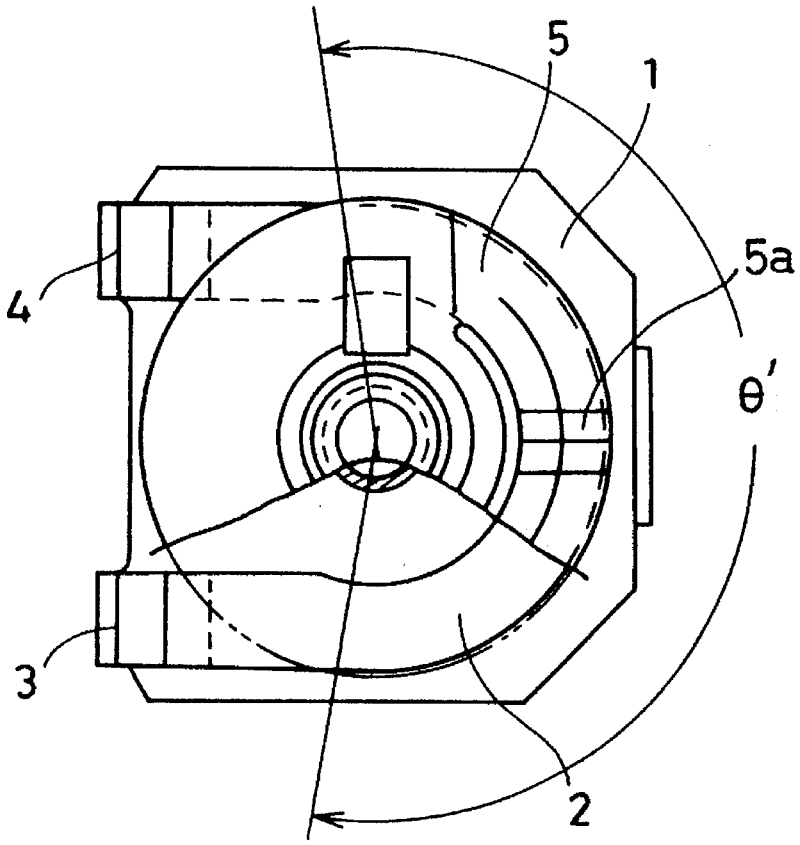
Fig. 17 PRIOR ART
FIG. 17 is a plan view showing the same prior art resistor.
Figure 18:
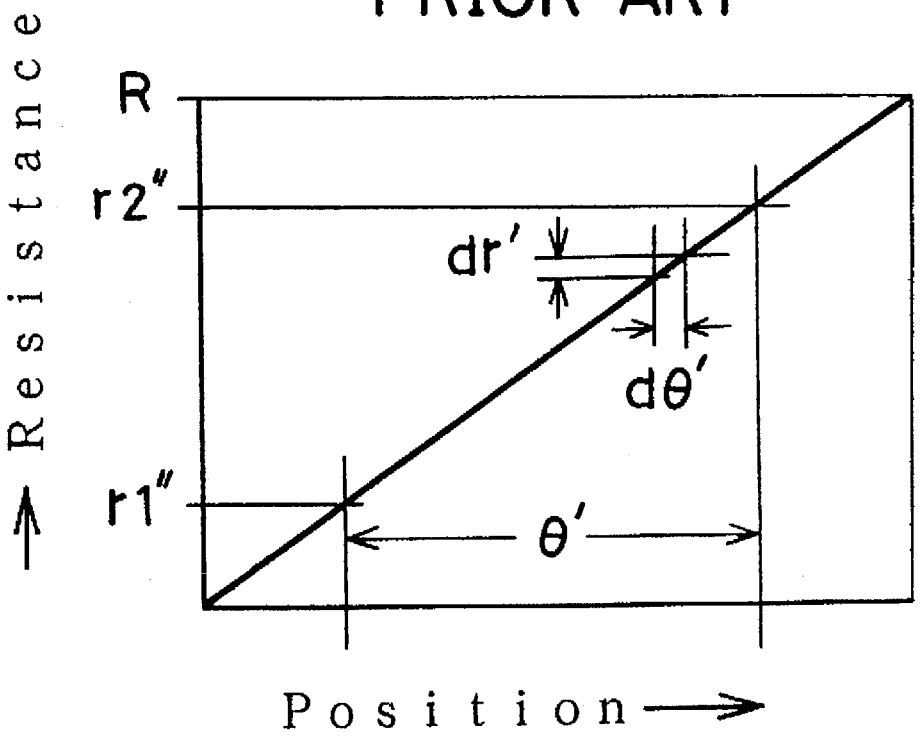
Fig. 18 PRIOR ART
FIG. 18 is a graph showing the resistance characteristics of the same prior art resistor.

FIGS. 13 and 14 shows a chip-type variable resistor according to a fourth embodiment of the present invention. The resistor of this embodiment differs from that of the first embodiment (FIGS. 1–3) only in that a generally U-shaped resistor strip 12D is single-layered but includes a pair of first material portions 12D*a'*, 12D*a"* made of a higher resistivity material and connected directly to respective extremity electrode terminals 13, 14, and an arcuate second material portion 12D*b* made of a lower resistivity material and formed between the higher resistivity portions in contact therewith.

According to the fourth embodiment, the second material portion 12D*b* has a lower area resistivity (defined as a resistance per unit surface area) than the first material portions 12D*a'*, 12D*a"*. Thus, the variable resistor of this embodiment exhibits a resistance characteristics curve which is similar to that shown in FIG. 4.

On the other hand, the resistor strip 12D as a whole is single-layered substantially without any step (level difference) at the joints between the first and second material portions. Thus, the unillustrated rotor (cf. FIG. 1) can be turned smoothly for resistance adjustment.

The fourth embodiment may be modified so that the respective first material portions 12D*a'*, 12D*a"* have different lengths to shift the resistance characteristics curve upward or downward (see FIG. 10). Further, one of the first material portions may be omitted, and the second material portion 12D*b* is extended into direct electrical contact with either one of the extremity electrode terminals 13, 14.

FIG. 15 shows a fifth embodiment which is similar to the fourth embodiment in that a generally U-shaped resistor strip 12E is also single-layered. However, the resistor strip 12E of this embodiment comprises three first material portions 12E*a'*, 12E*a"*, 12E*a'"* of a higher area resistivity, and two second material portions 12E*b'*, 12E*b"* of a lower area resistivity. Two first material portions 12E*a'*, 12E*a"*, which are substantially straight, are directly connected to respective extremity electrode terminals 13, 14, whereas the first material portion 12E*a'"* is arcuate and spaced from the foregoing first material portions 12E*a'*, 12E*a"*. The two second material portions 12E*b'*, 12E*b"*, which are also arcuate, are arranged between the three first material portions.

According to the fifth embodiment, the first material portions 12E*a*', 12E*a*", 12E*a*"' are arranged alternately with the second material portions 12E*b*', 12E*b*". Thus, the variable resistor of this embodiment provides a resistance characteristics curve which includes a lower-side finely adjustable range and a higher-side finely adjustable range with a coarsely adjustable range interposed between the two finely adjustable ranges (cf. FIG. 12). Further, due to the surface flatness of the resistor strip 12E, the unillustrated rotor (cf. FIG. 1) can be smoothly rotated for resistance adjustment.

The present invention being thus described, it is obvious that the same may be varied in many ways. For instance, the insulating substrate 11 may be optionally configured. Further, the two extremity electrode terminals 13, 14 may be arranged at different sides of the insulating substrate 11. Such variations are not to be regarded as a departure from the spirit and scope of the invention, and all such modifications as would be obvious to those skilled in the art are intended to be included within the scope of the following claims.

I claim:

1. A chip-type variable resistor comprising:

an insulating substrate having a surface formed with a resistor strip, the resistor strip having a first end portion electrically connected to a first extremity electrode terminal, the resistor strip also having a second end portion electrically connected to a second extremity electrode terminal, the resistor strip further having an arcuate adjustable resistance region between, but not including, the first and second end portions;

an intermediate terminal member mounted on the substrate; and a contact member electrically connected to the intermediate terminal member and rotatably mounted on the substrate in slidable contact with the adjustable resistance region of the resistor strip;

wherein the adjustable resistance region of the resistor strip includes at least one portion having a first area resistivity, the area resistivity being defined as a resistance per unit surface area of the resistor strip;

wherein each of the first and second end portions has a second area resistivity which is higher than said first area resistivity;

wherein the first end portion of the resistor strip differs in length from the second end portion; and wherein a combined length of the first end portion and the first extremity electrode terminal on said surface of the substrate is equal to a combined length of the second end portion and the second extremity electrode terminal on said surface of the substrate.

2. The variable resistor according to claim 1, wherein the resistor strip comprises a first resistor layer extending for the full length of the resistor strip into electrical connection with the first and second extremity electrode terminals, and a second resistor layer formed in lamination with the first resistor layer, the second resistor layer being shorter than the first resistor layer to be spaced from both of the first and second extremity electrode terminals.

3. The variable resistor according to claim 1, wherein the substrate is further formed with an auxiliary conductor pad at each end of the adjustable resistance region of the resistor strip.

4. The variable resistor according to claim 1, wherein a portion of the first extremity electrode terminal extends on said surface of the substrate into electrical connection with the first end portion, a portion of the second extremity electrode terminal also extending on said surface of the substrate into electrical connection with the second end portion, said portion of the first extremity electrode terminal differing in length from said portion of the second extremity electrode terminal.

5. The variable resistor according to claim 1, wherein each of the first and second end portions is non-arcuate.

6. The variable resistor according to claim 5, wherein each of the first and second end portions is straight.

* * * * *